US006361192B1

(12) United States Patent
Fussell et al.

(10) Patent No.: US 6,361,192 B1
(45) Date of Patent: Mar. 26, 2002

(54) LENS SYSTEM FOR ENHANCING LED LIGHT OUTPUT

(75) Inventors: David A Fussell, Suwanee; James W. Gibboney, Jr., Conyers, both of GA (US)

(73) Assignee: Global Research & Development Corp, Suwanee, GA (US)

( * ) Notice: Subject to any disclaimer, the term of this patent is extended or adjusted under 35 U.S.C. 154(b) by 0 days.

(21) Appl. No.: 09/426,310

(22) Filed: Oct. 25, 1999

(51) Int. Cl.[7] ..... F21V 5/04

(52) U.S. Cl. ..... 362/331; 362/256; 362/355; 362/84; 362/335; 362/810; 362/268

(58) Field of Search ..... 362/246, 255, 362/256, 355, 356, 357, 84, 331, 311, 268, 329, 335, 340, 447, 810, 800; 313/512; 257/98

(56) References Cited

U.S. PATENT DOCUMENTS

| | | | | | |
|---|---|---|---|---|---|
| 326,459 | A | | 9/1885 | Sprague | 362/255 |
| 1,086,787 | A | | 2/1914 | Rithner | 362/255 |
| 1,155,600 | A | | 10/1915 | Metzger et al. | 362/255 |
| 1,174,377 | A | | 3/1916 | Appleton | 362/255 |
| 2,949,531 | A | | 6/1960 | Lemelson | 240/81 |
| 3,860,847 | A | * | 1/1975 | Carley | 313/512 |
| 4,264,948 | A | | 4/1981 | Cherouge | 362/311 |
| 4,270,162 | A | | 5/1981 | Cherouge | 362/311 |
| 4,698,730 | A | | 10/1987 | Sakai et al. | 362/311 |
| 5,113,329 | A | | 5/1992 | Lin | 362/238 |
| 5,140,220 | A | | 8/1992 | Hasegawa | 313/512 |
| 5,221,140 | A | | 6/1993 | Oshino | 362/255 |
| 5,455,755 | A | * | 10/1995 | Bandy | 362/84 |
| 5,499,174 | A | | 3/1996 | Lin | 362/353 |
| 5,539,628 | A | | 7/1996 | Seib | 362/293 |
| 5,782,553 | A | * | 7/1998 | McDermott | 362/245 |
| 5,786,582 | A | * | 7/1998 | Roustaei et al. | 235/462 |
| 5,909,954 | A | * | 6/1999 | Thomas | 362/355 |
| 5,931,570 | A | * | 8/1999 | Yamura | 362/355 |

* cited by examiner

*Primary Examiner*—Alan Cariaso
(74) *Attorney, Agent, or Firm*—Michael A Mann; Timothy J Slabouz; Nexsen Pruet Jacobs & Pollard LLC

(57) ABSTRACT

A light source enhancing lens assembly 10 has a carrier 20, a light source 30 carried by the carrier 20, a first lens 40 which refracts and diffuses light emitted from the light source 30 and a second lens 70 to defocus and further distribute the light emitting from the first lens 40. The light source 30 is inserted into the first lens 40, so that light from the LED is refracted within a first bore 48 and diffused by a frosted first outer surface 60 of the first lens 40. The first lens 40 inserts into a second bore 40 of the second lens 70. Light from the first lens 40 is further defocused by a series of parallel, spaced apart lens sections 82 located on the second outer surface 78 of the second lens 70.

33 Claims, 4 Drawing Sheets

LENS SYSTEM FOR ENHANCING LED LIGHT OUTPUT

BACKGROUND OF THE INVENTION

I. Field of the Invention

The present invention relates generally to lighting devices. More particularly, the present invention relates to lenses for lights.

II. Description of the Related Art

Light emitting diodes (LEDs) consume considerably less power than incandescent light bulbs, making their use highly desirable. To increase the luminosity of LEDs, lenses are placed in front of them, which focuses the light into a beam that is essentially perpendicular to the LED junction base. Inevitably, light dispersion from the LED is decreased, which limits the use of LEDs to specialized illumination applications.

LEDs are readily available in the market place. Three of the "standard" LEDs are a basic LED, a bright LED and an ultra bright LED. The basic LED has an output level between 1.5 to 10 mcd and a viewing angle from 75 to 100 degrees. The bright LED has an output level between 10 to 50 mcd and a viewing angle from 50 to 75 degrees. The ultra bright LED has an output level between 50 to 2,000 mcd and a viewing angle from 18 to 60 degrees. All of these LEDs are useful for a focused light beam application that ranges from situations where there is no ambient light situations to those in daylight.

Recent developments in LED technology have resulted in the availability of "super high intensity" LEDs. Super high intensity LEDs are commonly used in cluster applications to replace standard "spot" lamp applications and traffic warning devices. The output level is between 6,000 to 20,000 mcd and the viewing angle is a very narrow 4 to 8 degrees. Yet, use of this powerful LED is still limited to focused light applications due to its narrow viewing angle design. A significant problem occurs when a LED is used and the viewer is outside the narrow range of its beam of light Intensity drops off precipitously.

Use of devices such as fresnel lenses or reflectors can assist the human eye in detecting light emitted by an LED over wider viewing angles. However, use is still limited to relatively focused light applications designed for viewing directly in front of the LED.

Various attempts have been made to broaden the LED light beam. For example, a self-powered ornamental lighting device is described in U.S. Pat. No. 4,866,580 by Blackerby. This device includes a LED encased within a bulb. This bulb appears to have no particularly special refracting nor diffusing characteristics. In another embodiment, a metal foil reflector is used to reflect light emitted from the LED.

Similarly, German Patent Number 41 20 849 A1 by Sitz describes an ornamental lighting apparatus using an LED and a bulb enclosure having the characteristics of a candle flame. Like Blackerby above, this member also appears to have no particularly special refracting nor diffusing characteristics.

U.S. Pat. No. 4,965,488 by Hili describes a light-source multiplication device having a planer lens with multiple facets. An LED emits light toward the planer lens. Surrounding the LED is a reflector to reflect any laterally emitted light from the LED toward the planer lens. Light beams transmitted by the planer lens are parallel to one another.

An LED lamp including a refractive lens element is described in U.S. Pat. No. 5,174,649 by Oilstone. The lamp includes one or more LEDs that illuminate the refractive lens element, which has hyperboloids and facets, to give the effect of its being fully illuminated. However, the lighting effect from the lens remains in a narrow viewing angle and in front of the LED. Once the viewer out of the viewing angle, the effect will not readily be apparent.

As described in U.S. Pat. No. 5,311,417 issued to Hey, an Illuminative Sucker & Decorative String Thereof comprises a sucker having a sucker cup portion and a back portion formed on a back portion of the sucker cup portion, a lamp socket secured to the back portion of the sucker and a lamp inserted in the lamp socket. Both the lamp socket and the sucker may be made of translucent or transparent materials. The sucker cup portion has a cavity formed in the cup portion to enable it to be adhered to a flat surface. Once the lamp is lit, the lamp projects light beams toward the back portion of the sucker, especially when the lamp is an LED, causing the back portion to glow unidirectionally. As shown and described, the lamp socket is not a lens that refracts or diffuses light, but is provided to contain the lamp and permit the lamp to emit a unidirectional light beam toward the back portion of the sucker. This is further demonstrated by the shade fitted to the sucker so that light emitted from an incandescent bulb is totally projected onto the back portion.

Lemelson, in U.S. Pat. No. 2,949,531, describes an Illuminated Highway Marker. The marker comprises a base having a rigid housing secured thereto and an electric lamp disposed within the housing. Surrounding the housing is a cover of a transparent plastic which is flexible but thick enough to protect the rigid housing from impact. Although the housing is rounded to one hundred eight degrees of the body diameter to form a convex apex, the apex is not hyperbolically-shaped. As a result, light emitted from an LED striking the apex would not refract and diffuse to illuminate the total outside surface of the housing. The cover has the same shape as the housing and is not capable of defocusing and omnidirectionally distributing the light emitted from an LED.

SUMMARY OF THE INVENTION

According to its major aspects and broadly stated, the present invention is a light assembly that includes a carrier, a light source carried by the carrier, and a lens system. The lens system further comprises a first lens to refract and diffuse light emitted from the light source and a second lens to defocus and further distribute the light transmitted by the first lens. The light source is preferably a super high intensity LED, which is inserted into a bore formed in the first lens. Light from the LED is refracted by the first lens and diffused by its frosted outer surface. The first lens is itself inserted into a bore formed in the second lens. Light from the first lens is further defocused and diffused by a series of linear lens sections located on the outer surface of the second lens.

The ability to evenly distribute light over the surface of a single LED is a major advantage of the present invention. In order to evenly distribute the light, two lenses work in conjunction with each other to refract, diffuse and distribute light from the source.

Another important advantage of the present invention is the ability of the outer lens to take on an ornamental shape. This advantage allows the present lens assembly to be used in various novelty items, such as candles and jack-o-lanterns. In addition to taking on ornamental shapes, the lens assembly can carry a fluorescent material so that the lens assembly radiates absorbed light.

Other features and their advantages of the invention will become apparent from the following description taken in conjunction with the accompanying drawings showing the preferred embodiment of the invention.

DESCRIPTION OF THE PREFERRED EMBODIMENTS

Figure 1:
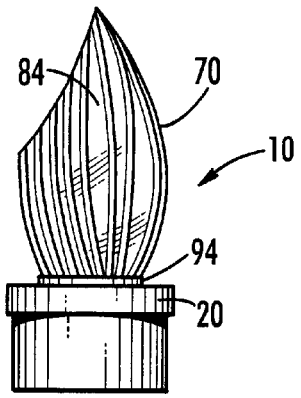
FIG. 1 is an elevation view of a light assembly made in accordance with the present invention.

For a fuller understanding of the nature of this invention, reference should be made to the following detailed description taken in connection with the accompanying drawings. In the drawings like reference numerals designate corresponding parts throughout the several figures.

FIG. 1 of the drawings illustrates a partial elevational view of an LED light assembly, generally illustrated by reference numeral 10. A carrier 20 provides a platform for removably supporting a lens assembly 25 and a light source 30. A suitable light source 30 can be any light generating means, including an incandescent bulb, but is preferably a light emitting diode (LED). A super high intensity LED is most preferred because of its extreme light brightness and the color or wavelength band it emits. Part of this band and light output level is irritating to the eyes and draws attention to the light source. Additionally, carrier 20 provides support for a diffusing and refracting internal first lens 40 and a complex, external second lens 70, that, together with light source 30 and carrier 20, comprise light assembly 10.

Figure 2:
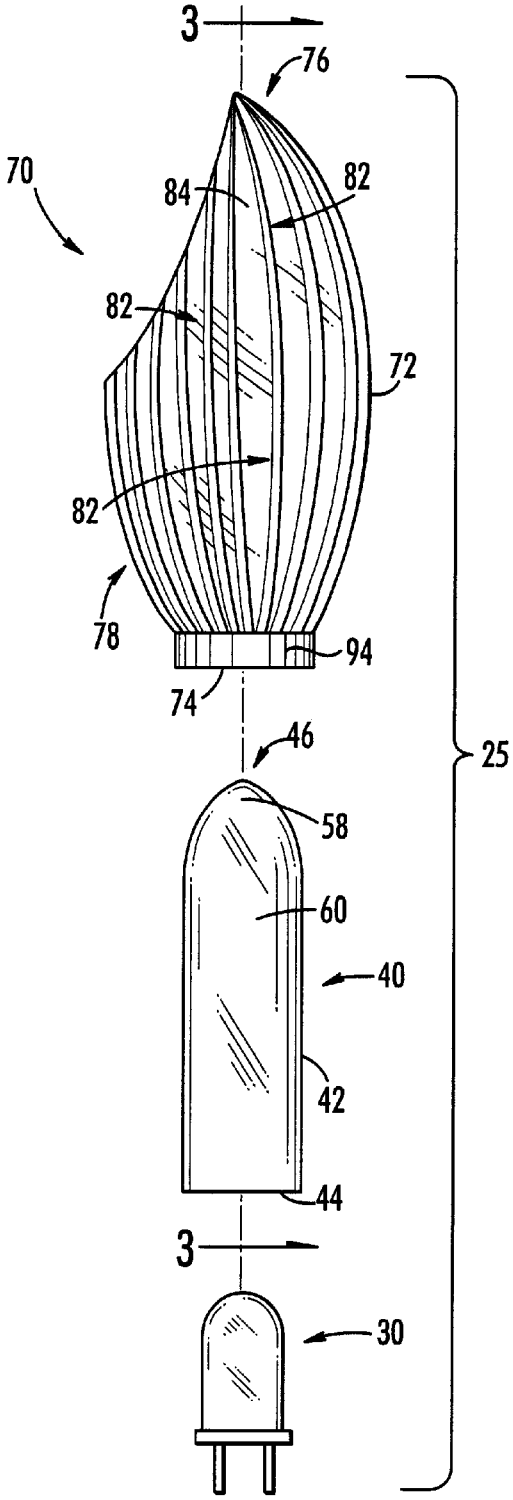
FIG. 2 is an exploded, elevation view of the lens assembly and light source.
Figure 3:
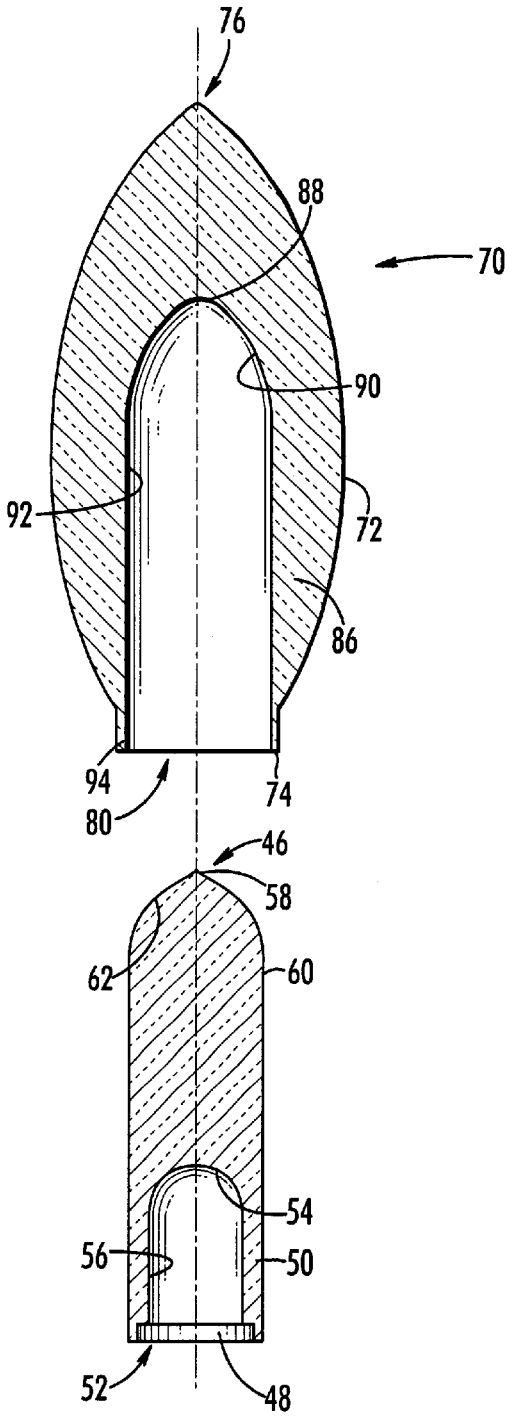
FIG. 3 is an exploded, sectional view of the lens assembly taken along Line 3—3 of FIG. 2.

Referring now to FIGS. 2 and 3, first lens 40 is used to soften and better colorize the output of light source 30. First lens 40 refracts light for the better distribution. First lens 40 is an elongated cylindrically-shaped member made of a highly dense, light transmissive material, such as glass or transparent plastic, preferably, acrylic. Because first lens 40 interacts directly with light source 30, it is important for the light transmissive material of first lens 40 to have the property of low light absorptivity. This property enables first lens 40 to transmit nearly all the light emitted from light source 30 even when the light is reflected repeatedly within it.

With continuing reference to FIGS. 2 and 3, first lens 40 has a cylindrical body 42, a first end 44 and a second end 46. Since body 42 is cylindrically-shaped, the longitudinal axis of first lens 40 runs between first and second ends 44 and 46. At first end 44 is a first bore 48 which extends into cylindrical body 42 and is centrally disposed within body 42 along its longitudinal axis. First bore 48 has a diameter and length sufficient to receive light source 30 within first bore 48. Preferably, first bore 48 is dimensioned and shaped to receive light source 30 with little clearance. Within first bore 48 are a first bore wall 50 and a first bore end 52. First bore end 52 defines a hemispherically-shaped, first concave surface 54. First bore wall 50 has a first bore inner surface 56. First concave and bore inner surfaces 54 and 56 may be lusterless or "frosted" so as to better diffuse the light entering body 42. In the preferred embodiment, first concave and bore inner surfaces 54 and 56 are smooth. At the second end 46, first lens 40 has a generally-hyperbolic shape except for an outwardly pointed apex 58. First lens 40 has a first outer surface 60 and a first lens inner surface 62, both of which extend from first end 44 to second end 46, and first outer surface 60 is frosted or distressed, or a combination of both. Distressing first outer surface 60 increases the external surface area of first lens 40. At second end 46, first lens 40 is generally hyperbolically-shaped to effect distribution of the narrow band of light that emanates from the light source 30. To provide proper distribution of light, the light needs a reflective surface that is hyperbolic in shape to cause the refraction of light over as much of first outer surface 60 as reasonably possible.

Figure 4:
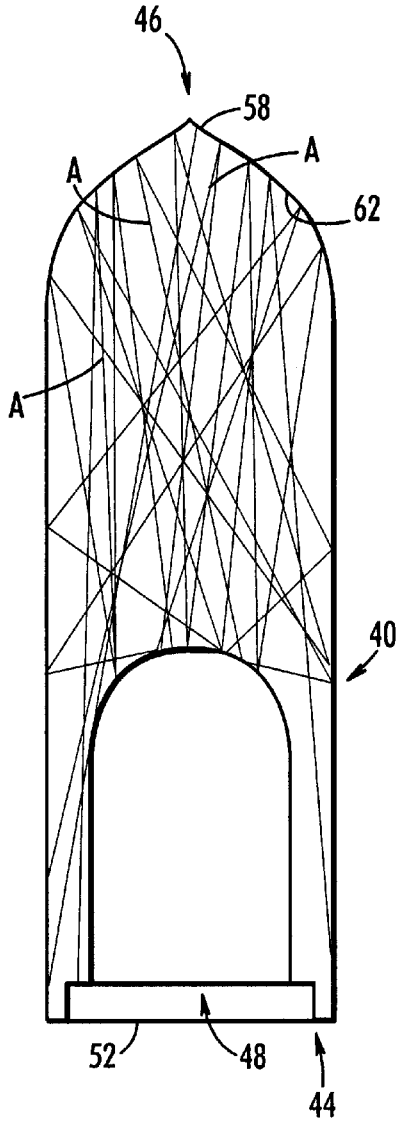
FIG. 4 is a sectional view of the first lens taken along Line 3—3 of FIG. 2 showing the refraction of light within the first lens.

As shown in FIGS. 2 through 5, second end 46 of first lens 40 is hyperbolic in shape, and this hyperbolic shape is important to the distribution of the narrow band of light that emanates from the LED disposed within first bore 48 of first lens 40. With particular reference to FIG. 4, the very narrow, super high intensity light beam emanating from light source 30, characterized in FIG. 4 as lines labeled as A, strikes the hyperbolically-shaped, curved first lens inner surface 62 at the second end 46 of first lens 40. Because of the high clarity of the light transmissive material, first lens inner surface 62 at the second end 46 of first lens 40 appears to be a mirrored surface from inside first bore 48, thus reflecting the very narrow, emitted light beam A into a widely and evenly distributed light beam A that strikes all of first lens inner surface 62 of first lens 40. Frosted first outer surface 60 diffuses this captured light while softening the harshness of the original light and causing first lens 40 to appear to glow from all viewing angles not blocked by carrier 20. Distressing first outer surface 60 increases the overall surface area of first lens 40 which, in turn, increases the light distribution and further lowers the sharp intensity of the light output of light source 30.

Once the light has been softened and widely distributed by first lens 40, its focus is de-enmphasized by second lens 70 to further soften it and to enhance the distribution of the light by passing it through a special complex lens group that is shaped for a specific purpose, and for aesthetics dictated by the target design.

Referring now to FIGS. 1 through 3, second lens 70 has a generally convex-shaped, cylindrical body 72 made of a solid, high-density, light transmissive material. Although not required, the light transmissive material used for second lens 70 is preferably the same as the material used for first lens 40. Second lens 70 has a first end 74, a second end 76 and a second outer surface 78. Disposed between the first and second ends 74 and 76 of second lens 70 is convex-shaped cylindrical body 72 with a second lens longitudinal axis co-axial with the longitudinal axis of first lens 40. At the first end 74 is a second bore 80 which extends into body 72 and is centrally disposed along the second lens longitudinal axis thereof. Second bore 80 has a diameter and length sufficient to receive first lens 40 therein. Preferably, second bore 80 receives first lens 40 and has a compatible shape to that of first lens 40 so that second bore 80 matingly and removably receives the first lens 40 with little radial clearance. If desired, second bore 80 can have a length along the second lens longitudinal axis that is sufficient to allow movement of the lens 70 for variable focus. The preferred embodiment of the convex shaped, cylindrical body 72 shown in the drawings is in the form of an ornamental candle flame. Cylindrical body may be formed in other ornamental shapes, such as a jack-o-lantern.

Again referring to FIGS. 1 and 2, protruding from the second outer surface 78 are a plurality of convex, roughly parallel lens sections 82 of predetermined depth and width extending from first end 74 to second end 76 of convex-shaped cylindrical body 72. Concentric lens sections 82 are formed on curved second outer surface 78. Although the shape of second lens 70 as illustrated is design specific, its shape remains consistent with the functional goals of light system 10. Even though second lens 70 is not limited to a specific number of concentric lens sections 82, the preferred embodiment has at least 20 concentric lens sections 82 which are spaced-apart from each other but equidistantly spaced. Between each of the concentric lens sections 82 is a face 84 which is flat.

With continuing reference to FIGS. 1 and 2, concentric lens sections 82 have a focal length such that frosted first outer surface 60 of first lens 40 is significantly magnified, and unfocused. This combination softens the light from light source 30, and allows for maximum light dispersion and an even distribution of the light, while producing a "halo" or glowing effect on second outer surface 78 of second lens 70. Each concentric lens section 82 on second outer surface 78 of second lens 70 distributes the light. The internal shape of second lens 70 reflects some of the light passing through it back inside second lens 70 where it strikes first outer surface 60 of first lens 40, further causing more even light distribution on first outer surface 60.

As shown in FIG. 3, second bore 80 has a second bore wall 86 and a second bore end 88. Comparable to first lens 40, second bore end 88 is rounded to form a hyperbolically-shaped, second concave surface 90. Within second bore 80, second bore wall 86 has a second inner surface 92, and second inner and concave surfaces 92 and 90 are preferably smooth. On the other hand, by using frosted second inner and concave surfaces 92 and 90, the diffraction effect is greater. A mounting rim 94 is provided at the first end 74 of the second lens 70. Mounting rim 94 removably engages carrier 20.

Figure 5:
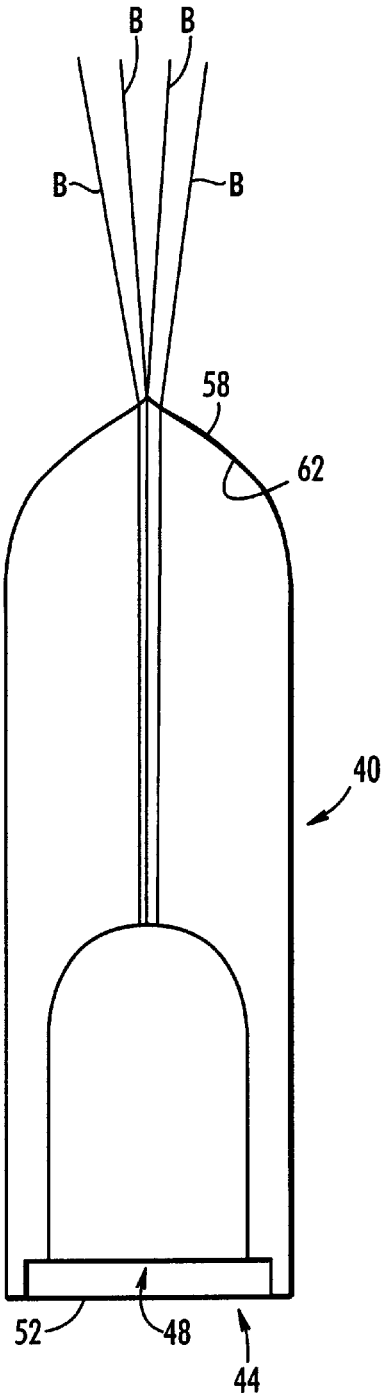
FIG. 5 is a sectional view of the first lens taken along Line 3—3 of FIG. 2 showing the refraction of light emitting from an apex.
Figure 6:
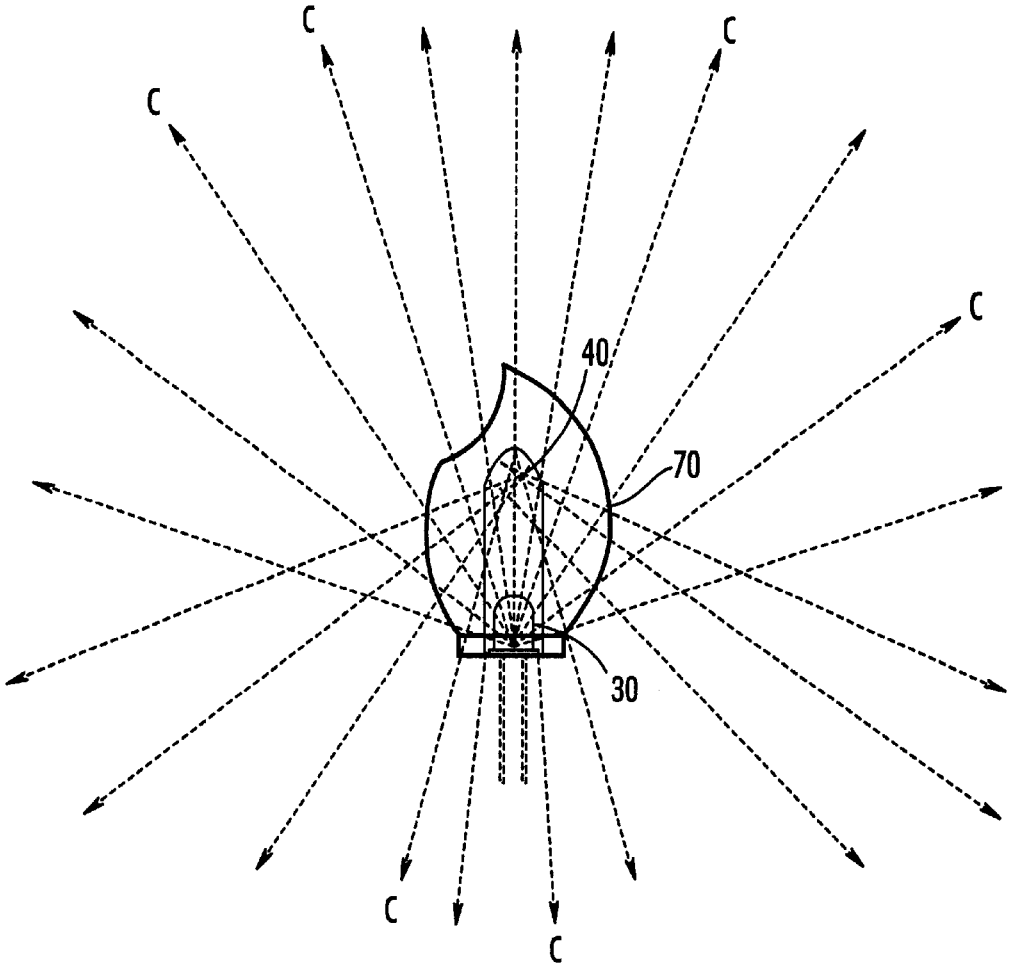
FIG. 6 is an elevation view of the lens assembly and light source showing the diffusion of light by the present invention.

Referring now to FIGS. 3, 5, and 6, depending on the distance of apex 58 of first lens 40 to second bore end 88, the intensity, focus and second end 76 light distribution over the second outer surface 78 of second lens 70 will change. If second end 76 of second lens 70 is to be bright, then the focus needs to be sharp. If more even light distribution over second outer surface 78 is desired and second end 76 of second lens 70 is not to be bright with respect to second outer surface 78, then the focus of first lens 40 to second bore end 88 of second lens 70 should be de-emphasized, i.e. made less sharp. Focus is controlled by the distance between first lens 40 and second bore end 88 of second lens 70. The focus stems from a relationship between the distance between first and second lenses 40 and 70 and the LED light aperture. This relationship will also vary depending on the use and shape of second lens 70. The hyperbolically-shaped second end 46 of first lens 40 reshapes the light beam B at that area into an inverted cone, as shown in FIG. 5. The closer apex 58 of first lens 40 comes to opposing second bore end 88 of second lens 70, the narrower the light beam B emanating from second end 46 of first lens 40 becomes, thus intensifying its output through concentration and narrower surface area dispersement. Conversely, as apex 58 of first lens 40 is pulled away from second bore end 88 of second lens 70, the wider the light beam B emanating from second end 46 of first lens 40 becomes. Consequently, as shown in FIG. 6, the wider light beam C covers more of second outer surface 78 of second lens 70, yields a less intense light output from second end 46 of first lens 40, and additionally illuminates more of second outer surface 78 of second lens 70 because of the internal refraction of the light beam C within second lens 70.

Lenses 40 and 70 may be coated or formed from a fluorescent material to appear to glow after exposure from light source 30. Preferably, lenses 40 and 70 have fluorescent material applied in one of three locations: coating first outer surface 60 of first lens 40, coating second inner surface 92 of second lens 70, and injecting a phosphoric dye into the material from which first lens is formed.

In use, second lens 70 slidably receives first lens 40 at second bore 80 which, in turn, receives light source 30 in first bore 48. Lens assembly 25 and light source 30 are fitted to carrier 20. First lens 40 is fully inserted into second bore 80 such that first end 44 of first lens 40 is adjacent to first end 74 of second lens 70. With Light source 30 energized, second lens 70 further defocuses the light emitting from first lens 40 and enhances light distribution by magnification through concentric lens sections 82. The light is further distributed by refraction within second bore 80 as in first lens 40 and first bore 48. The combination of first lens 40 and second lens 70 softens the light from light source 30, and allows for maximum light dispersion and even distribution of the light, while producing a "halo" effect on the secend outer surface 78 of second lens 70.

Various modifications may be made of the invention without departing from the scope thereof and it is desired, therefore, that only such limitations shall be placed thereon as are imposed by the prior art and which are set forth in the appended claims.

LIST OF COMPONENTS (For Convenience Of The Examiner)

10. Light-source enhancing lens assembly
20. Carrier
30. Light source
40. First lens
42. Cylindrical body of first lens
44. First end of first lens
46. Second end of first lens
48. First bore
50. First bore wall
52. First bore end
54. First hemispheric concave surface
56. First bore inner surface
58. Apex
60. First outer surface of first lens
62. First lens inner surface
70. Second lens
72. Convex-shaped cylindrical body of second lens
74. First end of second lens
76. Second end of second lens
78. Second outer surface
80. Second bore
82. Concentric lens sections
84. Top of concentric lens sections
86. Second bore wall
88. Second bore end
90. Second concave surface
92. Second inner surface
94. Mounting rim

What is claimed is:

1. A lens assembly for evenly distributing light from a light source, comprising:

a first lens having a first outer surface, said first lens having a distribution means for refracting and diffusing light; and a second lens in spaced relation to said first lens and having a second outer surface, said second lens having means for defocusing light emitted by said first lens, wherein said second outer surface has a plurality of parallel, spaced apart lens sections formed thereon.

2. The lens assembly as recited in claim 1, wherein said first lens is carried within said second lens.

3. The lens assembly as recited in claim 1, wherein said second lens has a bore formed therein for receiving said first lens.

4. The lens assembly as recited in claim 1, wherein said first lens has a first bore and said second lens has a second bore, said first lens being received within said second bore of said second lens.

5. The lens assembly as recited in claim 1, wherein said first lens has a first bore and said second lens has a second bore, said first lens being received within said second bore of said second lens, said first and said second bores being co-axial.

6. The lens assembly as recited in claim 1, wherein said second lens has a bore formed therein that has a bore end, said bore end being hyperbolically-shaped.

7. The lens assembly as recited in claim 1, wherein said first lens has a bore formed therein that has a bore end, said bore end being hemispherically shaped.

8. A light assembly for evenly distributing light from a light source, comprising:

a first lens having a first end and an opposing second end and a first bore formed therein, and wherein said second end of said first lens is hyperbolically shaped;

a second lens having a second bore formed therein, said first lens being carried within said second bore; and a light source carried within said first bore.

9. The light assembly as recited in claim 8, wherein said first lens has an outer surface that is frosted.

10. The light assembly as recited in claim 8, wherein said first lens has an outer surface that is distressed.

11. The light assembly as recited in claim 9, wherein said second lens has a second outer surface with a plurality of spaced apart lens sections formed thereon.

12. The light assembly as recited in claim 8, wherein said first and said second lenses carry a fluorescent material.

13. The light assembly as recited in claim 8, wherein said second bore is longer than said first lens so that the position of said first lens within said second bore can be adjusted.

14. The light assembly as recited in claim 10, wherein said first bore is formed in said first end of said first lens and wherein said first bore is hemispherically shaped.

15. A light assembly for evenly distributing light from a light source, comprising:

a light emitting diode having an output of at least 6000 mcd;

a first lens having a first outer surface, said first lens having a first bore dimensioned to receive said light emitting diode; and a second lens having a second bore dimensioned to receive said first lens.

16. The light assembly as recited in claim 15, wherein said first lens carries a fluorescent material.

17. The light assembly as recited in claim 15, wherein said first lens has an outer surface that is frosted.

18. The light assembly as recited in claim 15, wherein said second lens has an outer surface that carries a plurality of spaced apart lens sections.

19. A lens assembly for evenly distributing light from a light source, comprising:

a first lens having a first outer surface, said first lens having a distribution means for refracting and diffusing light; and a second lens in spaced relation to said first lens and having a second outer surface, said second lens having means for defocusing light emitted by said first lens, wherein said second lens has a bore formed therein that has a bore end, said bore end being hyperbolically-shaped.

20. The lens assembly as recited in claim 19, wherein said first lens is carried within said second lens.

21. The lens assembly as recited in claim 19, wherein said second lens has a bore formed therein for receiving said first lens.

22. The lens assembly as recited in claim 19, wherein said first lens has a first bore and said second lens has a second bore, said first lens being received within said second bore of said second lens.

23. The lens assembly as recited in claim 19, wherein said first lens has a first bore and said second lens has a second bore, said first lens being received within said second bore of said second lens, said first and said second bores being co-axial.

24. The lens assembly as recited in claim 19, wherein said first lens has a bore formed therein that has a bore end, said bore end being hemispherically shaped.

25. A lens assembly for evenly distributing light from a light source, comprising:

a first lens having a first outer surface, said first lens having a distribution means for refracting and diffusing light; and a second lens in spaced relation to said first lens and having a second outer surface, said second lens having means for defocusing light emitted by said first lens, wherein said first lens has a bore formed therein that has a bore end, said bore end being hemispherically shaped.

26. The lens assembly as recited in claim 25, wherein said first lens is carried within said second lens.

27. The lens assembly as recited in claim 25, wherein said second lens has a bore formed therein for receiving said first lens.

28. The lens assembly as recited in claim 25, wherein said first lens has a first bore and said second lens has a second bore, said first lens being received within said second bore of said second lens.

29. The lens assembly as recited in claim 25, wherein said first lens has a first bore and said second lens has a second bore, said first lens being received within said second bore of said second lens, said first and said second bores being co-axial.

30. A light assembly for evenly distributing light from a light source, comprising:

a carrier;

a light emitting diode having an output of at least 6000 mcd carried by said carrier; and a lens carried by said carrier and having a convex-shaped, cylindrical body and an outer surface, said lens having a first bore formed therein and dimensioned to receive said light emitting diode, said first bore having a bore end.

31. The light assembly as recited in claim 30, wherein said outer surface is frosted.

32. The light assembly as recited in claim 30, wherein said bore end is hyperbolically shaped.

33. The lens assembly as recited in claim 25, wherein said second outer surface of said second lens is in the form of a candle flame.

* * * * *